US011802403B2

(12) United States Patent
Argyrou

(10) Patent No.: US 11,802,403 B2
(45) Date of Patent: Oct. 31, 2023

(54) METHOD FOR CONSTRUCTING A CONCRETE FLOOR IN A MULTISTOREY BUILDING

(71) Applicant: Hickory Design Pty Ltd, Melbourne (AU)

(72) Inventor: George Argyrou, Elwood (AU)

(73) Assignee: HICKORY DESIGN PTY LTD, Melbourne (AU)

( * ) Notice: Subject to any disclaimer, the term of this patent is extended or adjusted under 35 U.S.C. 154(b) by 565 days.

(21) Appl. No.: 16/092,808

(22) PCT Filed: Jun. 5, 2017

(86) PCT No.: PCT/AU2017/050546
§ 371 (c)(1),
(2) Date: Oct. 11, 2018

(87) PCT Pub. No.: WO2017/219069
PCT Pub. Date: Dec. 28, 2017

(65) Prior Publication Data

US 2019/0136507 A1 May 9, 2019

(30) Foreign Application Priority Data

Jun. 23, 2016 (AU) ..... 2016902460
Aug. 1, 2016 (AU) ..... 2016903025
(Continued)

(51) Int. Cl.
*E04B 1/348* (2006.01)
*E04B 5/23* (2006.01)
(Continued)

(52) U.S. Cl.
CPC ..... *E04B 1/34815* (2013.01); *E04B 1/34823* (2013.01); *E04B 5/04* (2013.01);
(Continued)

(58) Field of Classification Search
CPC .... E04B 1/34815; E04B 1/34823; E04B 5/04; E04B 5/18; E04B 5/23; E04B 5/38;
(Continued)

(56) References Cited

U.S. PATENT DOCUMENTS 3,300,943 A 1/1967 Owens
3,568,380 A 3/1971 Stucky
(Continued)

FOREIGN PATENT DOCUMENTS

CA 933376 A 9/1973
CN 110439259 A 11/2019
(Continued)

OTHER PUBLICATIONS

International Search Report for Application No. PCT/AU2017/050546 dated Sep. 29, 2017 (5 pages).
(Continued)

*Primary Examiner* — Monica A Huson
*Assistant Examiner* — Kelsey C Grace
(74) *Attorney, Agent, or Firm* — Michael Best & Friedrich LLP

(57) ABSTRACT

The invention provides a method of forming a concrete floor of a multistorey building, the method including: installing a first building module having a first precast concrete floor slab adjacently spaced from a second building module having a second precast concrete floor slab, at least the first precast concrete floor slab supporting an upstanding support member for supporting an upper floor; forming a channel between the spaced first and second precast concrete floor slabs by providing supporting formwork between the floor slabs for supporting poured concrete; and pouring concrete into the channel to form a concrete connection between the first and second precast slabs, thereby forming a concrete floor of a building.

11 Claims, 14 Drawing Sheets

(30) Foreign Application Priority Data

Jan. 27, 2017 (WO) ..... PCT/AU2017/050063
Jan. 27, 2017 (WO) ..... PCT/AU2017/050064

(51) Int. Cl.

| | |
|---|---|
| ***E04B 5/38*** | (2006.01) |
| ***E04G 21/12*** | (2006.01) |
| ***E04B 5/04*** | (2006.01) |
| ***E04B 5/18*** | (2006.01) |
| ***E04G 11/48*** | (2006.01) |
| ***E04G 11/56*** | (2006.01) |
| *E04B 1/20* | (2006.01) |
| *E04C 5/08* | (2006.01) |

(52) U.S. Cl.
CPC ..... *E04B 5/18* (2013.01); *E04B 5/23* (2013.01); *E04B 5/38* (2013.01); *E04G 11/48* (2013.01); *E04G 11/483* (2013.01); *E04G 11/56* (2013.01); *E04G 21/12* (2013.01); *E04B 1/20* (2013.01); *E04B 2103/02* (2013.01); *E04C 5/08* (2013.01)

(58) Field of Classification Search
CPC ..... E04B 1/20; E04B 2103/02; E04G 11/48; E04G 11/483; E04G 11/56; E04G 21/12; E04C 5/08
See application file for complete search history.

(56) References Cited

U.S. PATENT DOCUMENTS

| | | | | |
|---|---|---|---|---|
| 3,613,325 | A | 10/1971 | Yee | |
| 3,918,222 | A | 11/1975 | Bahramian | |
| 4,023,315 | A | 5/1977 | Stucky | |
| 4,147,009 | A | 4/1979 | Watry | |
| 4,221,098 | A | 9/1980 | Mayer et al. | |
| 4,435,927 | A | 3/1984 | Umezu et al. | |
| 4,443,985 | A | 4/1984 | Moreno | |
| 4,470,227 | A | 9/1984 | Bigelow, Jr. et al. | |
| 4,546,530 | A * | 10/1985 | Rizk | E04B 1/3483 29/430 |
| 5,224,321 | A | 7/1993 | Fearn | |
| 6,223,480 | B1 | 5/2001 | Khoo | |
| 6,625,943 | B1 | 9/2003 | Renner | |
| 6,651,393 | B2 | 11/2003 | Don et al. | |
| 7,581,709 | B2 | 9/2009 | Gillespie et al. | |
| 8,291,675 | B2 | 10/2012 | Tikhovskiy | |
| 8,336,276 | B2 | 12/2012 | Tikhovskiy | |
| 9,371,648 | B1 | 6/2016 | Tikhovskiy | |
| 9,487,943 | B2 | 11/2016 | Bui | |
| 10,066,390 | B2 | 9/2018 | Pospisil et al. | |
| 10,260,224 | B1 | 4/2019 | Jazzar | |
| 10,501,948 | B2 | 12/2019 | Lizarazu Zaldua et al. | |
| 2012/0167502 | A1 | 7/2012 | Tikhovskiy | |
| 2013/0055671 | A1 | 3/2013 | Bruce | |
| 2013/0305629 | A1 | 11/2013 | Stephenson et al. | |
| 2014/0298745 | A1 | 10/2014 | Rechenmacher | |
| 2015/0308096 | A1* | 10/2015 | Merhi | E04G 21/14 52/745.1 |
| 2016/0251853 | A1 | 9/2016 | Rubel et al. | |
| 2021/0376261 | A1 | 12/2021 | Boudreault et al. | |

FOREIGN PATENT DOCUMENTS

| | | | |
|---|---|---|---|
| DE | 102016012237 | A1 | 7/2018 |
| EP | 1184521 | A1 | 3/2002 |
| FR | 2901820 | A1 | 12/2007 |
| GB | 1101597 | A | 1/1968 |
| GB | 1271024 | A | 4/1972 |
| GB | 1350599 | A | 4/1974 |
| KR | 100873846 | | 12/2008 |
| KR | 20130083100 | A | 7/2013 |
| RU | 2376424 | C1 | 12/2009 |
| WO | 2005108700 | | 11/2005 |
| WO | 2011106842 | | 9/2011 |
| WO | 2012045149 | A1 | 4/2012 |
| WO | 2012070281 | A1 | 5/2012 |
| WO | 2017093221 | A1 | 6/2017 |
| WO | 2019034279 | A1 | 2/2019 |

OTHER PUBLICATIONS

International Search Report for Application No. PCT/AU2017/050064 dated Jun. 30, 2017 (5 pages).
International Search Report for Application No. PCT/AU2017/050063 dated May 4, 2017 (5 pages).
International Preliminary Report on Patentability for related Application No. PCT/AU2017/050064 dated Oct. 22, 2018 (85 Pages).
Office Action issued from the European Patent office for related Application No. 17814314.5 dated Jul. 22, 2021 (5 Pages).
Examination Report issued from the Australian Patent Office for related Application No. 2017282720 dated Dec. 13, 2021 (5 Pages).
Examination Report issued from the Australian Patent Office for related Application No. 2017280086 dated Dec. 21, 2021 (4 Pages).

* cited by examiner

METHOD FOR CONSTRUCTING A CONCRETE FLOOR IN A MULTISTOREY BUILDING

FIELD OF THE INVENTION

The invention relates to methods for constructing a concrete floor in multistorey buildings.

BACKGROUND OF THE INVENTION

In the construction industry modular buildings are becoming more popular as they can be largely constructed offsite and assembled on site into a finished product in shorter timeframes than traditional multi-storey buildings. Modular construction involves building and preparing building modules offsite in a factory setting before transporting and installing the module at an installation location. Despite the time saving benefits of modular construction techniques there is a constant pursuit to improve these methods of construction with the aim of achieving time savings and cost savings in the overall construction of the building.

It is in light of these pursuits for efficiencies in current the construction of modular buildings that the invention was conceived.

SUMMARY OF THE INVENTION

The invention provides a method of forming a concrete floor of a multistorey building, the method including: installing a first building module having a first precast concrete floor slab adjacently spaced from a second building module having a second precast concrete floor slab, at least the first precast concrete floor slab supporting an upstanding support member for supporting an upper floor; forming a channel between the spaced first and second precast concrete floor slabs by providing supporting formwork between the floor slabs for supporting poured concrete; and pouring concrete into the channel to form a concrete connection between the first and second precast slabs, thereby forming a concrete floor of a building.

An advantage of providing a method that uses concrete to connect adjacently spaced precast floor slabs, such as floor slabs in a building module, is that the step of pouring of concrete to connect the slabs can be decoupled from the construction and assembly of the building, particularly where the building is constructed with modular building units. Furthermore, the amount of formwork used with the present method of using hybrid wet and precast components is reduced compared to traditional multilevel building methods, when that formwork is provided as a separate structure to the precast floor slabs.

In one embodiment the method includes installing a third building module with a third precast concrete floor slab above the first precast concrete floor slab and supporting the third precast concrete floor slab on the upstanding support member. The method may include using a temporary support member or a permanent support member as the upstanding support member. The method may include using an upstanding support member in the form of a wall structure. The method may include installing the third precast concrete floor slab before the concrete is poured into the channel to form the concrete connection between the first and second precast slabs.

In another embodiment the method includes erecting formwork and pouring concrete to form a concrete beam connecting the floor slabs, thereby forming a floor of a building having a cast concrete beam. The method can include installing multiple precast floor slabs and casting beams extending between the slabs in different directions, such as perpendicular cast beams.

In another embodiment the method includes precasting the first precast concrete floor slab to have a first portion and a second portion, a thickness of the second portion being greater than a thickness of the first portion. The second portion may be precast to create an integrally formed concrete beam. The integrally formed concrete beam may span a length or width of the concrete slab. The method may include pouring the concrete to a thickness greater than the thickness the first portion of the first concrete floor slab. The method may further include pouring the concrete to a thickness substantially equal to the thickness of the second portion of the first concrete floor slab.

In another embodiment the method includes pouring the concrete to be level with a top surface of the first and second precast concrete floor slabs. The method may include precasting the first concrete floor slab to include a steel beam at least partially embedded into the first precast concrete floor slab.

The method preferably includes installing the slabs in elevation to define an upper storey floor. In a preferred embodiment the first and second precast floor slabs are each formed as part of a building modular, where building modules can be assembled one above the other with floor slabs suspended in elevation one adjacent the other.

The method may also include vertically inserting a prefabricated concrete wall panel in between the adjacently spaced precast floor slabs, erecting formwork between the precast floor slabs and pouring concrete into the formwork to tie the vertical wall panel to the floor slabs. Installing precast slabs vertically to form a wall between floor slabs, particularly elevated floor slabs, and then tying the wall slab to the floor slabs by way of the wet joint defined by the in situ poured concrete, provides an efficient means of installing structural support in a building.

The method also preferably includes post tensioning the precast floor slabs by, before pouring concrete into the channel, installing a conduit between bores extending through the first precast floor slab and the second precast floor slab to form a tensioning passage that extends through both the first and second precast floor slabs;

pouring concrete into the channel between the first and second precast concrete slabs to connect the first and second precast slabs, thereby forming a slab of a building; and feeding a tensioning cable, such as a tendon, through the tensioning passage and tensioning the tensioning cable.

Post tensioning of the formed connection, or 'wet joint' once it has dried, and the floor slabs increases the strength of the resulting concrete floor structure by compressing the concrete slabs. It is possible to tension the full span of a slab made from multiple precast concrete floor slabs. Alternatively, the concrete floor can be reinforced using reinforcement bars embedded into the poured and/or precast concrete.

The method could also include precasting any of the precast concrete floor slabs to include an integrally formed beam. For example, the first precast floor slab could have an integrally cast beam.

By providing a method that uses a combination of poured and precast beams it is possible to reduce the number of slab to beam connections, which can be complex and time consuming. In addition, by providing a precast concrete slab with integrally formed structural precast beams the remaining areas of the precast slab can be thinner than a slab with a constant thickness. In other words, by strengthening targeted areas of the precast concrete slab it is possible to reduce the overall weight of the slab for a given floor space. By reducing the weight for a given floor space the size of the precast concrete slab, or the building module that the precast concrete slab forms, can be increased while maintaining the same weight. This is beneficial as weight is a limiting factor dictating the size of building modules (the building modules need to be transported and lifted into position).

The second precast concrete slab may also have an integrally formed beam. The integrally formed beam of the second precast concrete slab may be co-axial with the integrally formed beam of the first precast concrete slab, when the second precast concrete slab is adjacent to the first precast concrete slab. Once the poured concrete beam has set the precast beam in the first precast concrete slab and the precast beam in the second precast concrete slab may form a single continuous beam.

The first precast concrete slab may have a second precast beam. The second precast beam in the first precast concrete slab may be perpendicular to the first beam in the first precast concrete slab.

The first precast concrete slab may have a reinforcing bar or angle that extends from the first precast concrete slab to anchor the first precast concrete slab to the poured concrete beam.

The first precast concrete slab may form the base of a building module. The first precast concrete slab, or the building module, may be made in a first location and transported to a second location for installation.

The first precast concrete slab may form the base of a building module. The first precast concrete slab, or the building module, may be made in a first location and transported to a second location for installation.

The invention also provides a method of forming a concrete floor of a multistorey building, the method including: installing a first building module having a first precast concrete floor slab adjacently spaced from a second building module having a second precast concrete floor slab, the first precast concrete slab having a first aperture extending through the first pre-cast concrete slab and the second concrete slab having a second aperture extending through the second pre-cast concrete slab; installing a conduit between the first aperture and the second aperture to form a tensioning passage that extends through both the first and second pre-cast concrete slabs; forming a channel between the spaced first and second precast floor slabs by providing supporting formwork between the floor slabs for supporting poured concrete; and pouring concrete into the channel to form a concrete connection between the first and second precast slabs, thereby forming a concrete floor of a building.

The method may include feeding a tensioning cable through the tensioning passage and tensioning the tensioning cable to post-tension the concrete floor.

BRIEF DESCRIPTION OF THE DRAWINGS

An embodiment, incorporating all aspects of the invention, will now be described by way of example only with reference to the accompanying drawings in which;

FIG. 10(*b*) is a side view showing one of the concrete floor illustrated in FIG. 10(*a*);

FIG. 11(*b*) is a perspective view of adjacently positioned building modules of the type illustrated in FIG. 11(*a*)

DETAILED DESCRIPTION OF AN EMBODIMENT OF THE INVENTION

FIGS. 1 to 9 illustrate methods of constructing a concrete floor in multilevel buildings with specific reference, by example, to multilevel buildings built with modular building units, or building modules.

Figure 1:
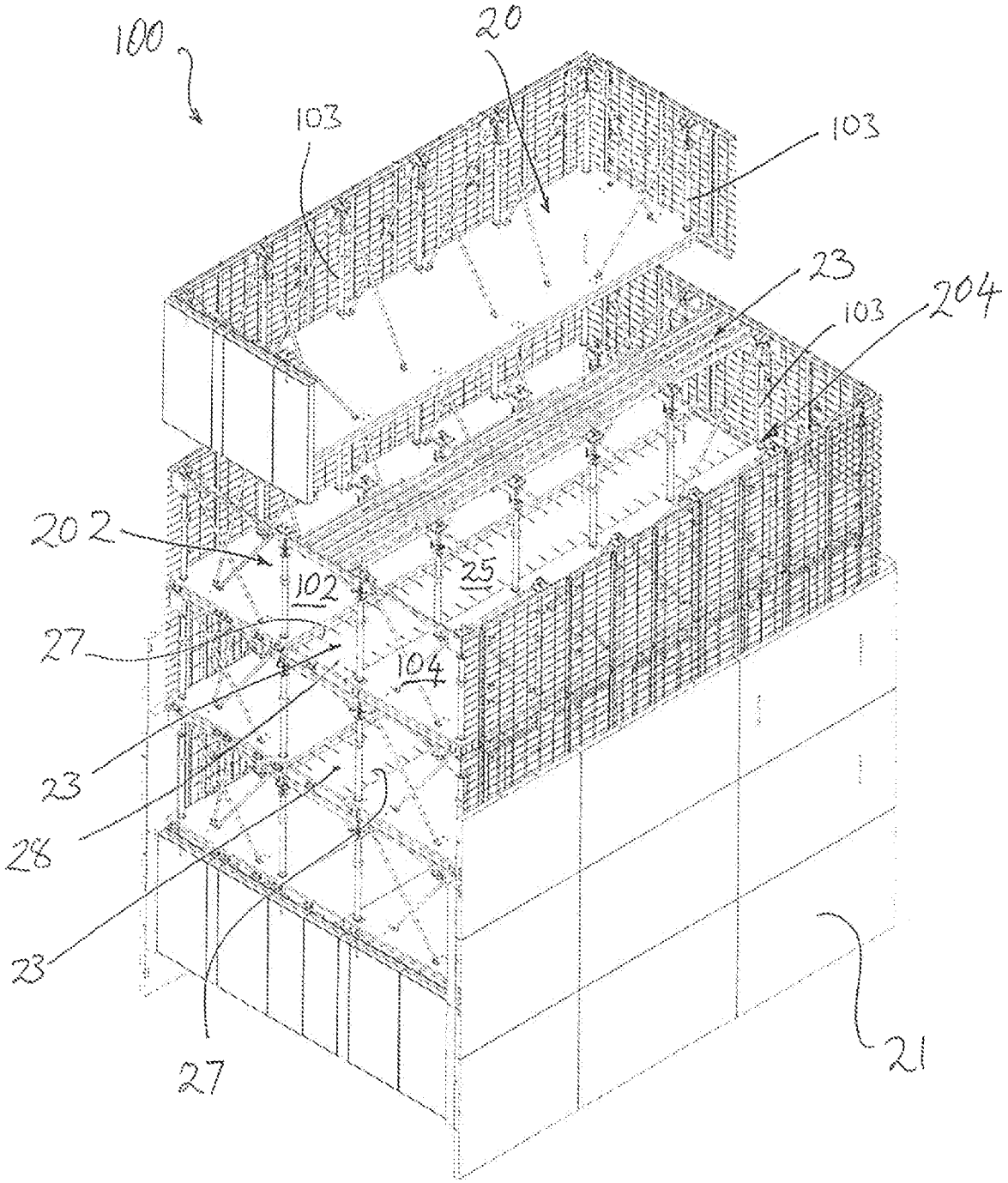
FIG. 1 is an isometric view of multi-storey building in which a concrete floor is being constructed in accordance with an embodiment of the present invention.
Figure 2A:
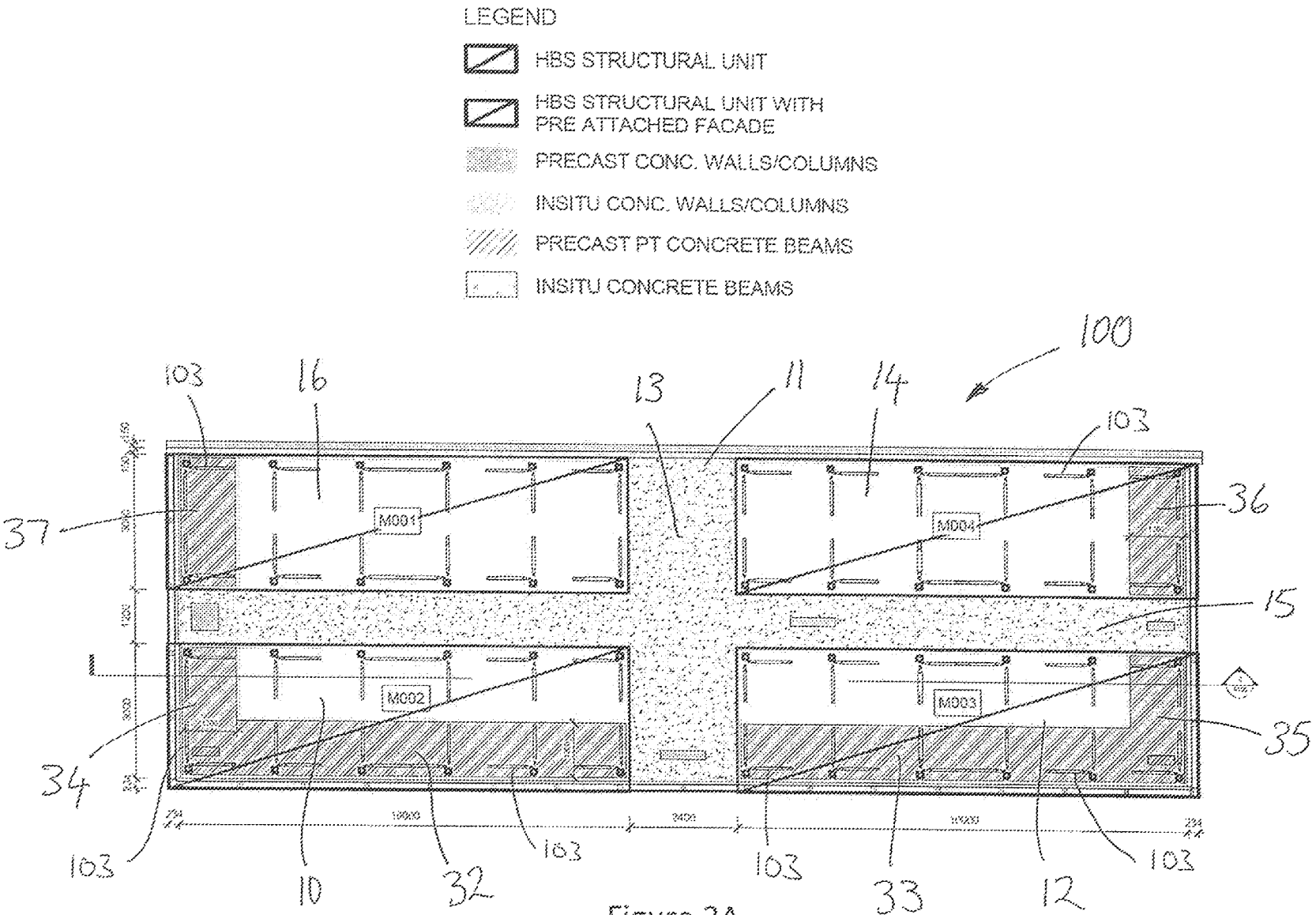
FIG. 2A is a plan view of a concrete floor of a building made in accordance with an embodiment of the present invention.
Figure 2B:
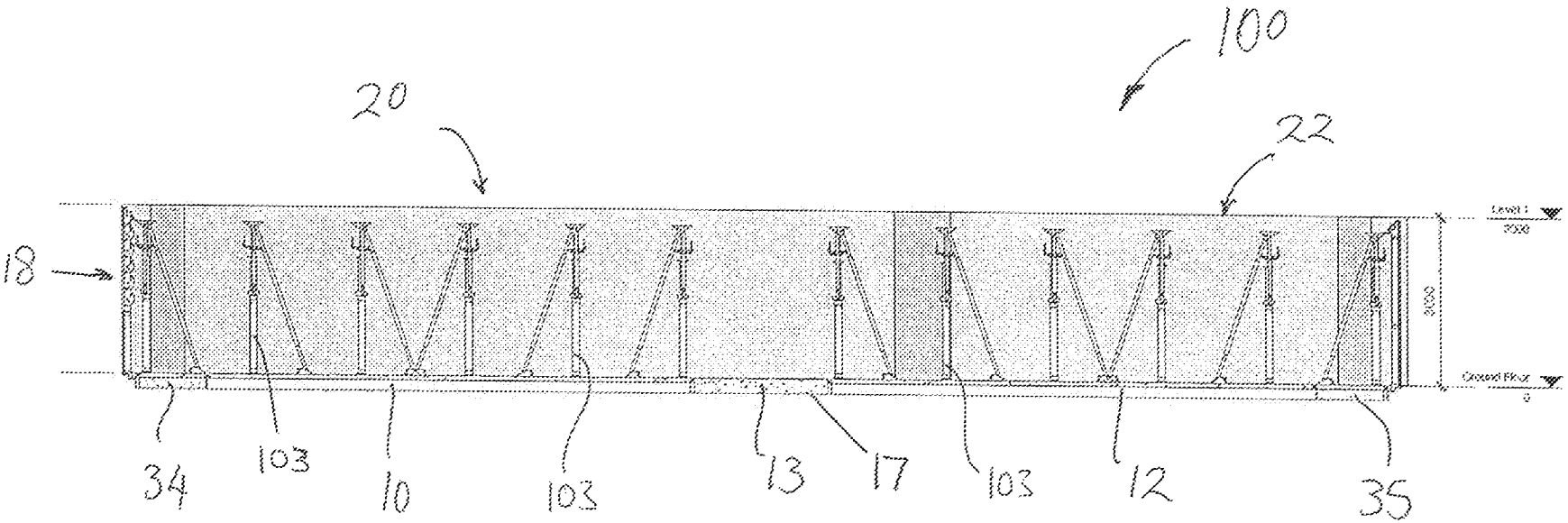
FIG. 2B is a cross-sectional view of the concrete floor in FIG. 2A, taken at the line A-A.

FIG. 1 illustrates a modular building 100, which is typically a multistorey building, made of building modules formed off site. FIG. 1 illustrates a building module 20 being lowered onto the top level of the multi-storey building 100 formed from assembled modules and partly clad with a façade 21. The transportation of each module from a first location off site to the installation site and the subsequent construction requires the modules to maintain a certain stability so that they can be handled by cranes and other handling equipment on and off the transportation vehicle, and placed or stacked on site so that they can support other modules placed on top.

The figures illustrate building units, or modules 20, 22, 24, 26, including respectively floor slabs 10, 12, 14, 16. Specifically, the floor slabs from adjacently spaced modules, are shown as 'stitched' together, in other words joined together by in situ wet joint connections of concrete. In the embodiment described, the connections are formed to create in situ beams for reinforcing a finished floor structure. The in situ formed joins, preferably in the form of beams, are structural joins that contribute to the structural stability of the building and therefore reduce the amount of vertical support required in the vicinity of the beams.

The floor slabs can be arranged in any orientation. In the embodiment illustrated the floor slabs, or building modules, are arranged side by side in two directions across a building storey (i.e. installing floor slabs a single horizontal plane). This means that the concrete is applied, by pouring or even by spraying, to create poured beams extending in multiple directions, such as in perpendicular directions as illustrated in the drawings. Installing the next level of the modular building 100 requires installing floor slabs above the already installed precast concrete floor slabs (i.e. installing vertically).

An advantage with the presently described system and method of forming a concrete floor of a multistorey building, and indeed the system and method of forming a multistorey building itself, is that the erection of the framework in the building, namely in the form of building units (modules), is decoupled from the process of joining the building units together.

In known building systems the floor of one storey needs to be completed, or joined together, by concreting to a substantially finished state before the walls can be erected on that floor. Furthermore, the walls need to be erected before the floor of the next storey up can be erected and supported by the walls.

In the present system and method, the framework including floor slabs and upright supports of multiple storeys can be erected in advance of the floors below being stitched together with concrete. This decoupling of erecting multiple storeys from concreting a floor increases building efficiencies and decreases building time because it is not necessary to wait for a freshly poured concrete floor to dry before the next level up can be built.

The in situ poured beams can either be tensioned by post tensioning techniques or reinforced with reinforcing steel. Accordingly, the resulting structure includes a concrete floor strengthened by 2-way tensioned or reinforced beams.

FIGS. 2A to 3B illustrate in plan view four floor slabs, shown as precast concrete floor slabs 10, 12, 14, 16, on a single level 18 of a multistorey building, shown as modular building 100. Each of the precast concrete slabs 10, 12, 14, 16 forms the base of the building modules 20, 22, 24, 26 respectively for the modular building. The precast concrete slabs 10, 12, 14, 16 are connected together by poured concrete 11 to form a completed floor slab 17. The term 'poured' is used herein but it is understood that the concrete could also be sprayed, or applied by other wet concrete techniques, to form a beam connection between individual floor slabs.

The precast concrete floor slabs 10, 12, 14, 16 each have at least one upstanding support member attached to them, where that upstanding support member is a permanent or temporary support with which, or on which, a further storey (usually another building module with a concrete slab) can be installed above the lower concrete floor slab to thereby construct a multi-storey building.

Figures 4A, 4B:
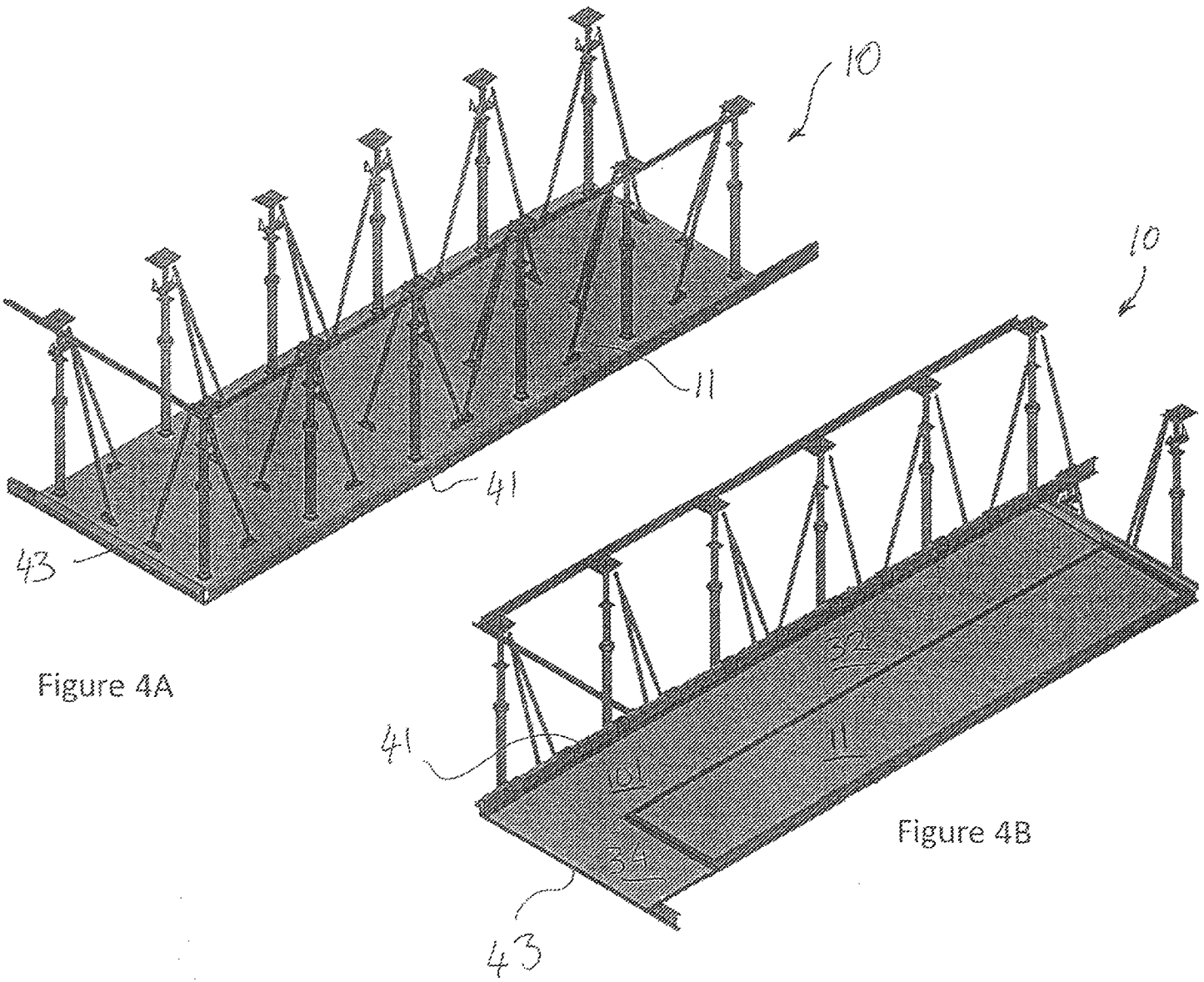
FIG. 4A is a top isometric view of a precast concrete floor slab having an integrally formed beam.
FIG. 4B is a bottom isometric view of the precast concrete floor slab in FIG. 4A.

For example, referring to FIG. 4A, precast concrete floor slab 10 has multiple upstanding support members, shown as temporary support members 103. The temporary support members 103 can be used to support a concrete floor above (not shown) while a wall, column or façade of floor slab 10 is erected, and can also be used to assist with support in erecting permanent vertical supports. The temporary supports are then removed as permanent vertical support is provided by the installed wall, column or façade.

Figure 3A:
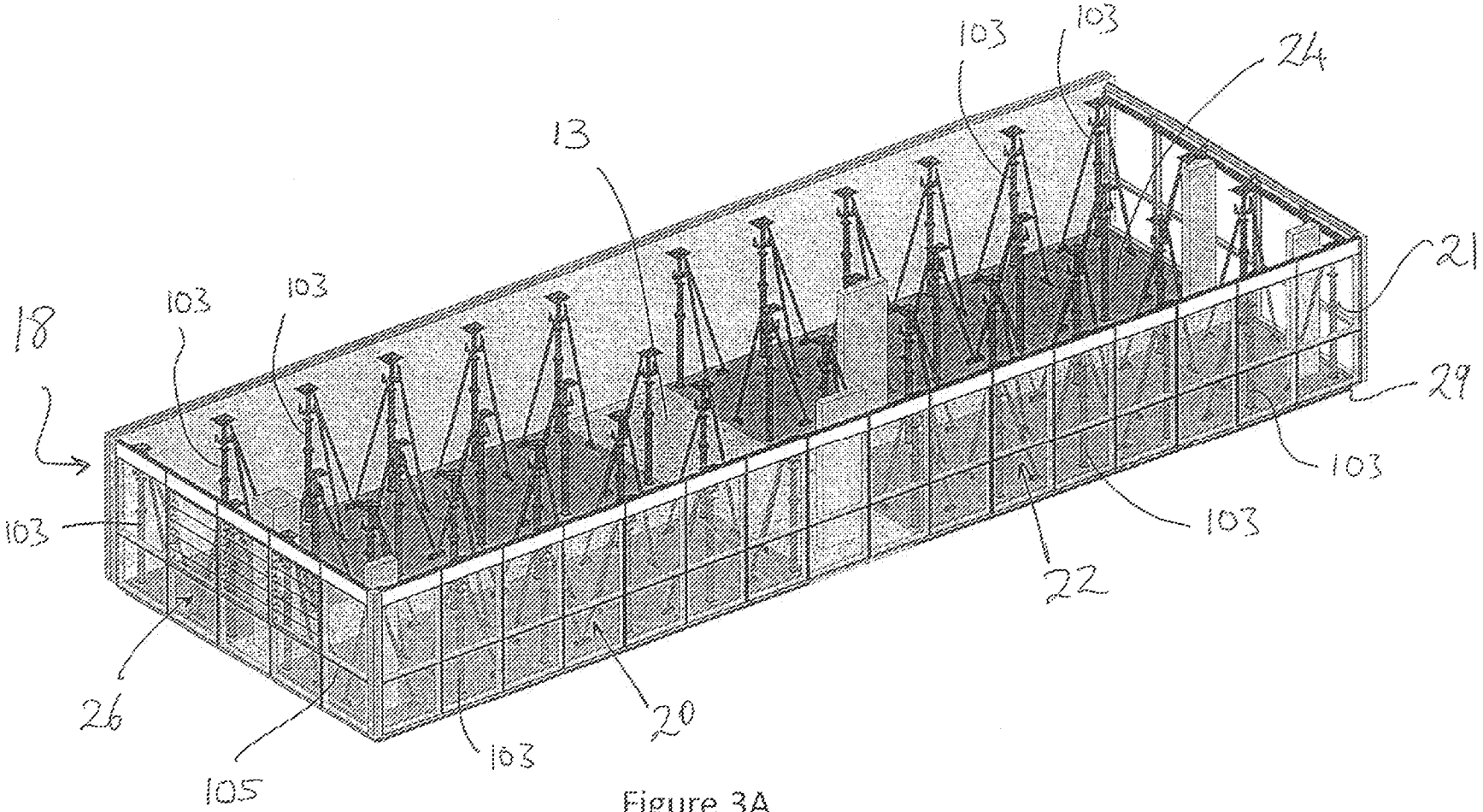
FIG. 3A is a top isometric view of the concrete floor in FIG. 2A.

The precast concrete floor slabs may be described as being provided with a wall structure. It is envisaged that the wall structure could be an internal wall, a façade wall, or a structure to allow creation of a wall (such as shutters for pouring or spraying concrete walls). As shown in FIG. 3A, the precast concrete floor slab 10 of module 20 has façade panels, shown as windows 105. In this embodiment the facade panels 105 are connected to their respective floor slabs through brackets 29 and fixing joints that are embedded into the side edges of the floor slabs during the precasting process. The side section views of FIGS. 6 and 9 also illustrate the facade 21 attached to the side of the precast concrete floor slabs 40, 240. In constructing a multistorey building in accordance with this embodiment, the entire module of floor slab and facade, with temporary upright supports, is craned and located in position above a storey with floor slabs below.

As an alternative to using temporary vertical/upright supports the wall structure itself on the precast concrete floor slab may form the upstanding support member providing the vertical support required to support a concrete floor slab of a storey above, or indeed to support multiple storeys above. Further still, a combination of temporary and permanent upstanding supports could be incorporated onto the concrete wall slab, as described with the facade embodiment above.

Referring to FIG. 1 by way of explanation, the temporary support members 103 act to vertically space the precast concrete floor of one level of the modular building 100 from another level of the modular building during construction. In this way the upper concrete floor slab is held in the correct position by the temporary support members 103 until the permanent support members are installed on site. Thereafter the temporary support members 103 may be removed and reused for the other building modules. It is envisaged that the aforementioned wall structures can be the permanent support members, once they are installed and attached to the upper concrete floor slab.

In the embodiments illustrated, the precast concrete slabs each have precast beams integrally formed into the precast concrete slabs 10, 12, 14, 16. Precast concrete slab 10 has two precast beams 32, 34. Precast concrete slab 12 has two precast beams 33, 35. Precast concrete slab 14 has one precast beam 36 32, 34. Precast concrete slab 16 has one precast beam 37. The integrally formed beams 32, 33, 34, 35, 36, 37 extend downwards from the precast concrete slabs 10, 12, 14, 16. The integrally formed beams are structural beams engineered to support the load of the building structure once constructed.

The term building module is intended to refer to a modular construction or building unit that is created off site, for example in a factory setting, and is transported on site to be assembled with other building modules to construct a multi-storey building. The building module could be provided in a basic form comprising a base and a frame, or facade, fixed to the base that forms the 'bones' of walls and a ceiling. Alternatively, the building module may comprise a building unit in an almost finished state including base, walls, ceiling and even fixtures. Logically, the building module may include a construction manufactured to a state between the basic and the almost finished forms discussed above.

Further information regarding methods for installing a building module above an existing building module (e.g. by using temporary support members) can be found in co-pending International Patent Application no. PCT/AU2017/050064 titled "METHODS AND APPARATUS FOR CONSTRUCTING MULTI-STOREY BUILDINGS", which also claims priority from Australian provisional application no. 2016902460 filed on 23 Jun. 2016 titled "METHODS AND APPARATUS FOR CONSTRUCTING BUILDINGS", and from Australian provisional application no. 2016903025 filed on 1 Aug. 2016 and titled "METHOD FOR CONSTRUCTING A CONCRETE FLOOR IN A MULTISTOREY BUILDING". The description and teachings of that co-pending international patent application is incorporated herein by reference to save reproducing that entire description herein.

Referring to FIGS. 4A and 4B, the precast concrete slab 10 of module 20 is shown in greater detail. The mould that is used to create the slab 10 is shaped so that the resulting slab has two beams 32, 34 integrally formed into the slab 10. The beams 32, 34 are of greater thickness than the portion 11 of the slab 10 that does not have a beam. In other words, the first precast concrete floor slab has a first portion 11 and a second portion 101, where the thickness of the second portion 101 is greater than the thickness of the first portion 11 (i.e. creating an integrally formed beam). The integrally formed beams 32, 34 provide additional strength and help to reduce the number of beams that need to be poured on site during construction, thereby reducing the amount of time taken to pour each level of concrete at the building site. This can lead to more efficient construction times.

It is, however, understood that the method of construction does not necessarily require the precast floor slabs to include integrally poured beams. The slabs may instead be planar and arranged to be stitched, ie. connected, to other slabs that may or may not have integrally formed beams in order to provide a strong concrete floor constructed from a series of interconnected precast concrete floor slabs.

An advantage of forming a finished concrete floor from precast floor slabs connected through wet joints is that a large portion of the work in making the floor, which in a preferred embodiment forms part of a more complex modular building unit, can be carried out in a controlled factory setting. Furthermore, prefabricating certain components of the build should increase the efficiency and speed of the build.

In the presently described example, a multistorey building using modular building units can be built faster than with known systems because the modular units can be assembled one atop the other without waiting for each floor to be completed first. Accordingly, and by way of example, five levels of building units could be assembled in two days while in that same amount of time two floors of the five levels may be finished by connecting the floor slabs together through wet joints. The method allows the construction of the building to be decoupled from the more time consuming task of pouring concrete and allowing it to dry.

For example, as already described above, during multistorey construction a precast concrete floor slab in a building unit will be installed above the first precast concrete floor slab 10. The upper building unit will be installed on top of and supported by the upstanding support members (e.g. the temporary support members 103 in some instances or permanent wall/facade structures or columns in other instances, or a combination of both) provided on the first, lower precast concrete floor slab 10. The installation of the upper precast concrete floor slab above the lower precast concrete floor slab 10 can be carried out before the concrete beams 13, 15 are poured. In this way the pouring of the concrete beams 13, 15 is decoupled from the installation of the precast concrete floor slabs, as the upstanding support members are capable of fully supporting the next level of the construction, and indeed are capable of supporting multiple upper levels (eg. 5 levels) of construction.

The building modules 20, 22, 24, 26 in a preferred embodiment comprise the precast concrete floor slabs 10, 12, 14, 16 and upright supports in the form of a facade 21, internal wall structure and/or temporary supports 103. The building modules could also include location devices that guide and correctly locate for attaching an upper module in the correct position above a lower module. As shown in co-pending International Patent Application no. PCT/AU2017/050064 the location device may be a cone-shaped locator pin provided on the upright support (which is a temporary tripod support in the embodiment of that co-pending application) that acts as a dowel and is adapted to locate into a corresponding recess in an underside of the floor slab or side attachment (such as a facade) of the building module to be mounted above. Accordingly, building modules can be correctly positioned one above the other in the desired storey configuration without requiring any concrete work to be first completed.

Turning back to FIGS. 4A and 4B, the first beam 32 is parallel to the long edge 41 of the slab 10. The second beam 34 is parallel to the short edge 43 of the slab 10. The first beam 32 is positioned at a perimeter of the slab 10. The second beam 34 is positioned at a perimeter of the slab 10. The first beam 32 extends across the entire length of the long edge 41 of the slab 10. The second beam 34 extends across the entire length of the short edge 43 of the slab 10. The first beam 32 is perpendicular to the second beam 34.

Although the beams have been shown as positioned at a perimeter of the slab 10, it is envisaged that the beams could be offset from the perimeter. In other words, the beams may be inset from a perimeter of the slab. In addition, although the beams have been shown as positioned parallel to either the short or long edge of the slab of a module, it is envisaged that the beams could be positioned at an angle relative to the short or long edges of the slab.

Referring again to FIGS. 2A to 3B, the precast concrete slab 10 is used as part of a method of laying a larger floor slab of a building. The first precast concrete slab 10, which is the base of building module 20, is installed on site and a second precast concrete slab, for example slab 12 of building module 22, is installed adjacent to and spaced from the first precast concrete slab 10. Supporting formwork 23, 39 is provided in the space 25 between the first and second slabs to form a channel 28 into which concrete for 'stitching' can be poured.

Figure 6:
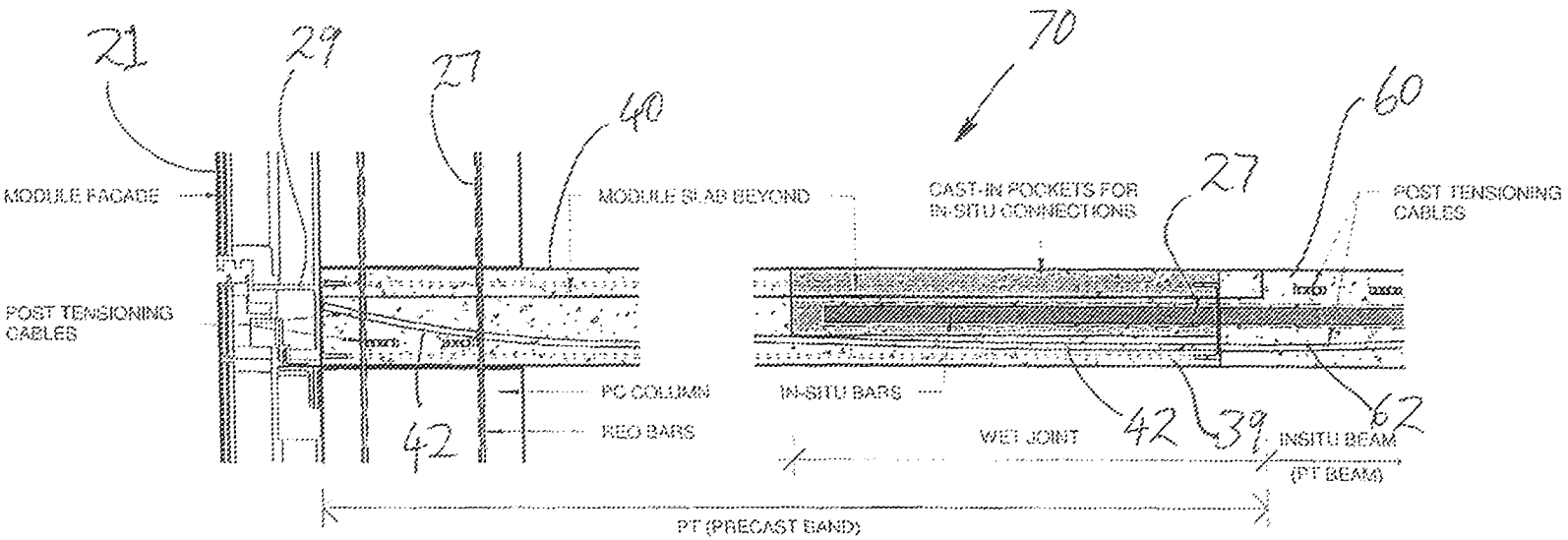
FIG. 6 is a zoomed out view of the view in FIG. 5 illustrating the first precast slab with the in situ concrete connection on one side and a façade building edge on the other.
Figure 10A:
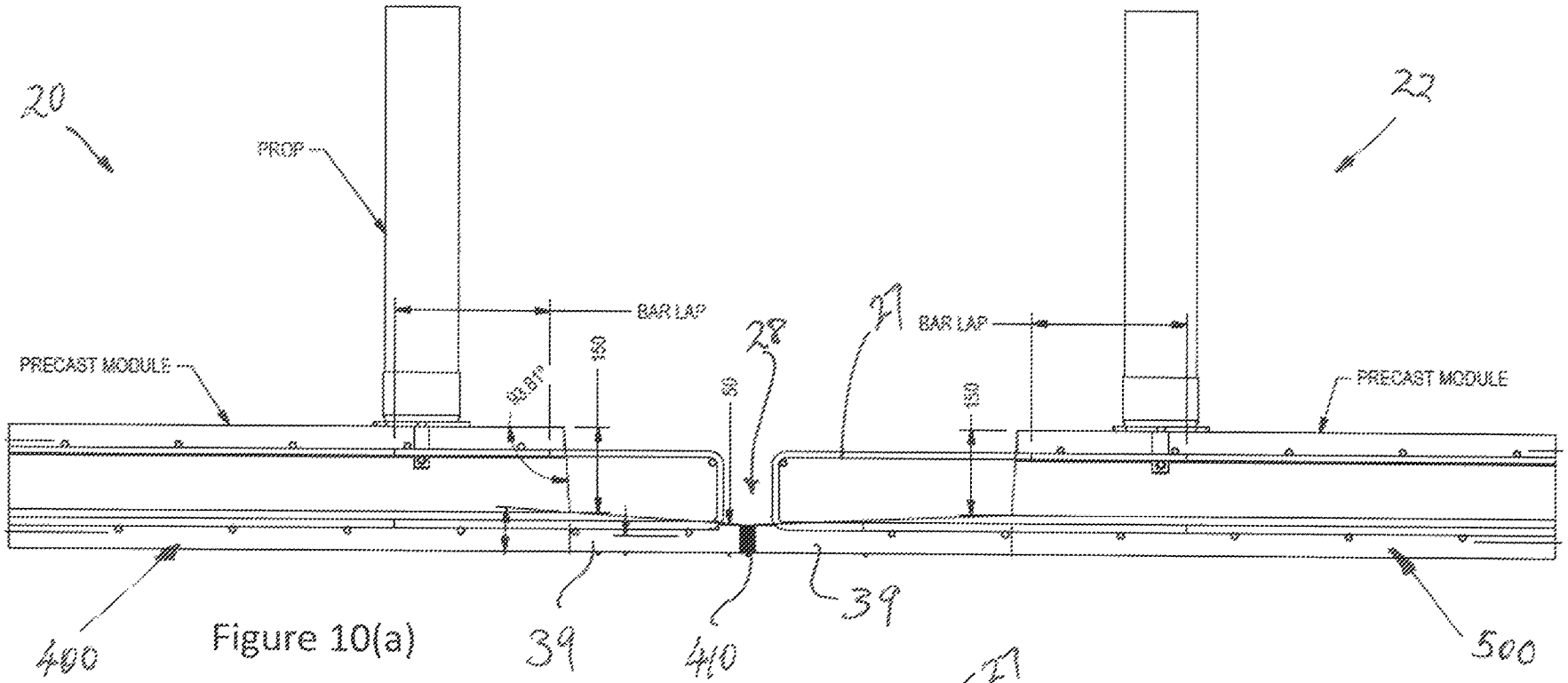
FIG. 10(*a*) is an enlarged view of another embodiment of the invention.
Figure 10B:
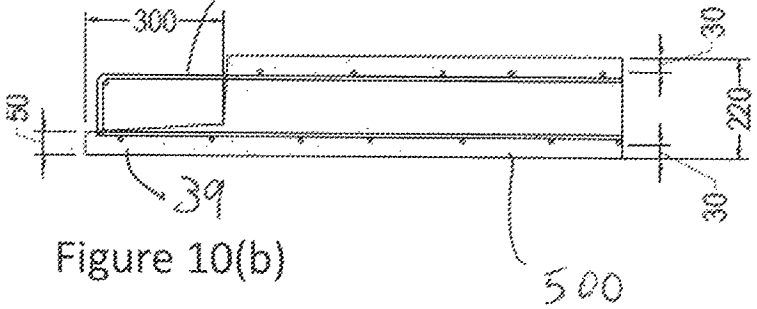

The supporting formwork could be provided as a separate structure, such as the sacrificial or removable formwork 23 as shown in FIG. 1, or as supporting formwork integrally formed with the precast floor slab, such as the flange 39 laterally extending from the side of the floor slab as shown in FIGS. 6, 10(*a*), 10(*b*), 11(*a*), 11(*b*) and 12.

FIG. 1 illustrates preliminary formwork (bearers) erected at ceiling height between two adjacently spaced building modules 202, 204, which will form the formwork for the floor of the storey above, and full formwork with board erected at floor level between building modules 202, 204, which forms the formwork 23 for the floor between building modules 202, 204. Also visible in FIG. 1 are reinforcement bars 27 protruding inwardly into the space 25 that will form the wet joint connection between the precast floor slabs 102, 104 of modules 202, 204 respectively. The reinforcement bars 27 tie together the precast floor slabs 102, 104 with the poured (wet joint) connection once the in situ poured connection is dried. The formwork forms a channel 28 into which concrete can be poured.

Concrete is poured into the channel 28 created by the formwork 23 to form a continuous concrete floor between the precast concrete floor slabs or, as shown in the embodiments of the drawings, concrete is poured to form beam 13 between the first precast concrete slab 10 and the second precast concrete slab 12. Whether or not a beam is formed, the result is a continuous floor slab 17 of a building 100. The concrete is poured to be level with a top surface of the first and second precast concrete floor slabs 10, 12. In other words, the poured concrete does not form a topping slab that overlays the first and second precast concrete floor slabs 10, 12 (although this may be performed if desired). The poured concrete beam 13 is angled relative to the integrally formed beam 32 in the first precast concrete slab 10, thereby forming a two-way tensioned or reinforced slab. In particular, the poured concrete beam 13 is perpendicular to integrally formed beam 32.

An alternative embodiment but with similar effect is illustrated in FIGS. 10(*a*) to 12. In that embodiment adjacent floor slabs 400, 500 are precast to have flanges 39, or tongues, extending laterally of the sides of the floor slabs. The flanges of each floor slab are positioned facing each other with only a small gap 410 left between them, which is filled with a plastic or silicone filler. The almost abutting flanges 39 are thinner in height/thickness than the height/thickness of the floor slabs and so create a channel 28 where the two adjacent slabs meet. Similar to the above-described embodiment of the formwork 23 provided as a separate, non-integral structure, the channel 28 is adapted to be filled with wet concrete to create an in situ wet joint.

Figure 11A:
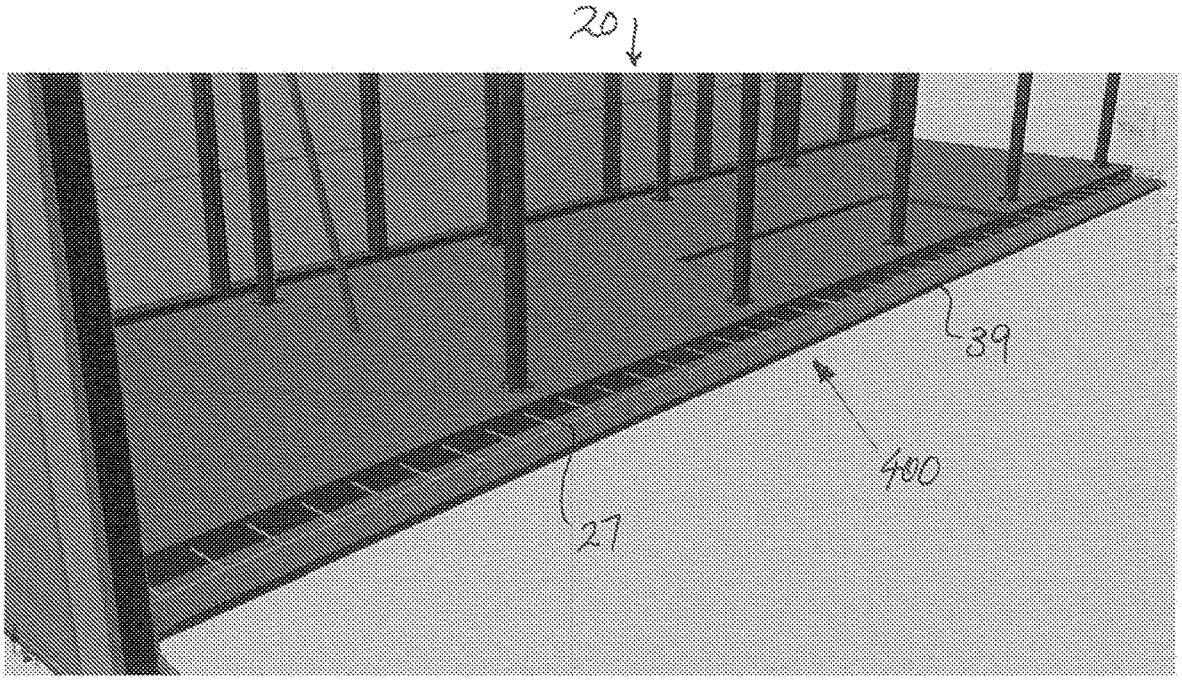
FIG. 11(*a*) is a perspective view of a building module having a concrete floor as illustrated in FIGS. 10(*a*) and 10(*b*)
Figure 11B:
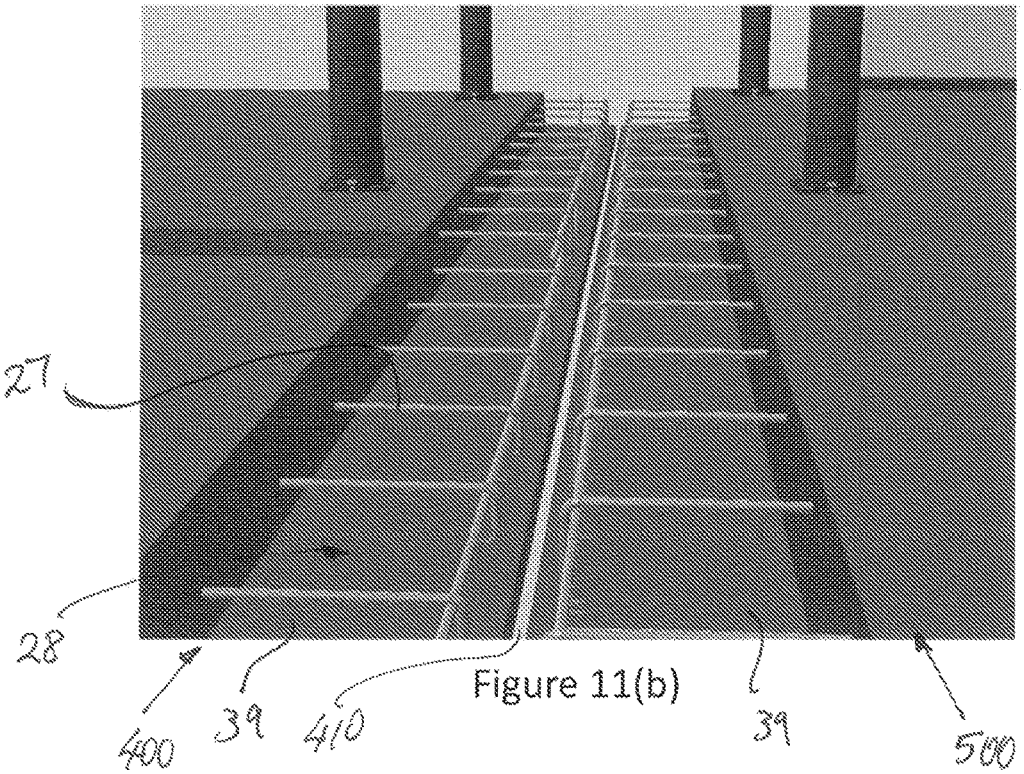
Figure 12:
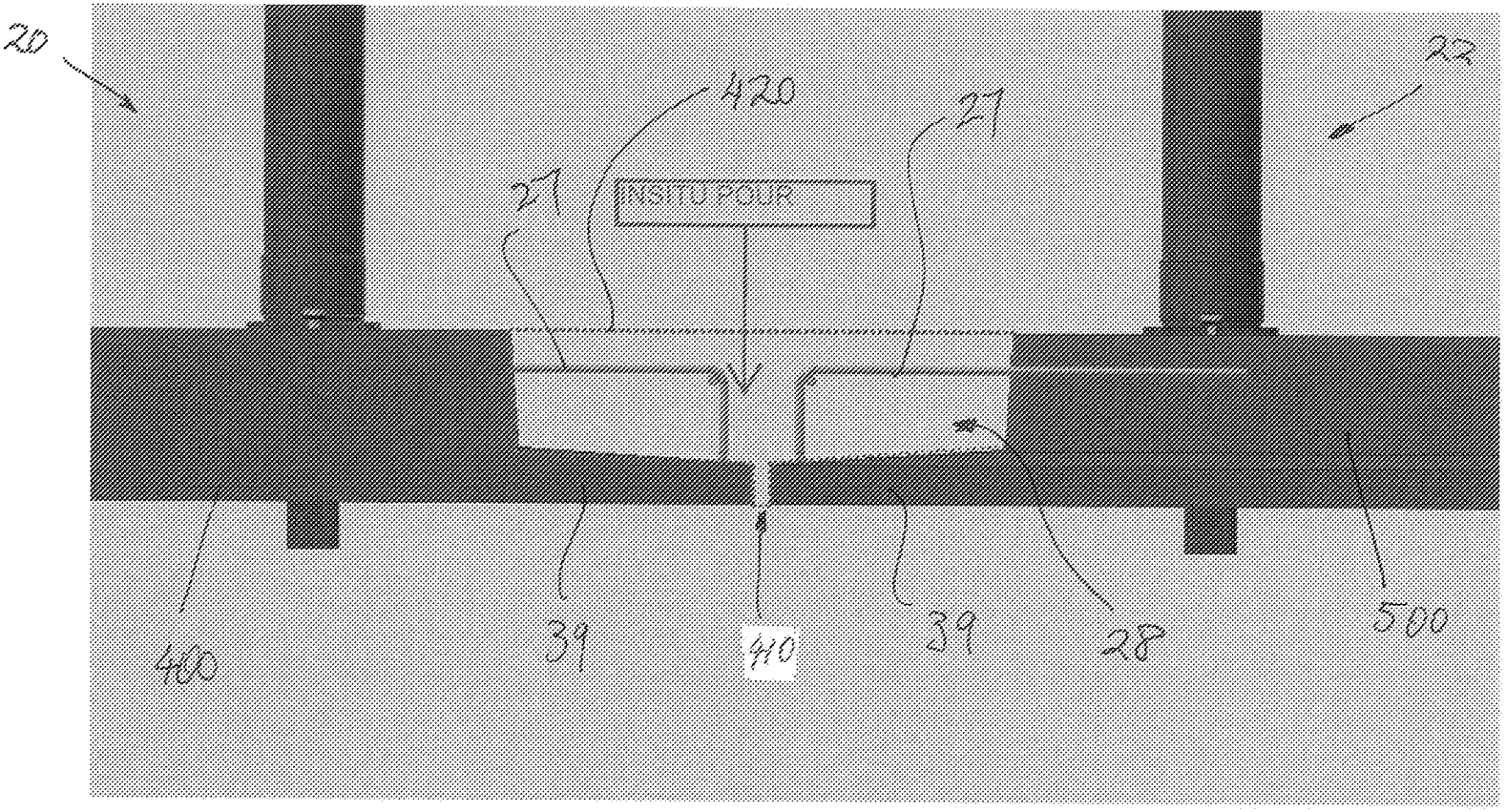
FIG. 12 is a side view similar to FIG. 10(*a*) illustrating diagrammatically the channel into which concrete is to be poured.

FIGS. 11(*a*) and 11(*b*) illustrate in perspective views a first module 20 with floor slab 400 that is located against a second module 22 with floor slab 500 ready for pouring, but before filling gap 410 with a filler. The cross-section diagram of FIG. 12 indicates in dotted lines the area 420 which will be occupied with in situ poured concrete. Reinforcement tie bars 27 embedded in the floor slabs 400, 500 protrude sideways into the wet joint area 420.

Referring back to FIG. 2A, the completed slab 17 has four precast concrete slabs 10, 12, 14, 16 and two poured concrete beams 13, 15. The thickness of the poured concrete beams 13, 15 are substantially equal to the thickness of the integrally formed precast beam in the precast concrete slabs 10, 12, 14, 16. In other words the concrete beams 13, 15 are poured to a thickness greater than a thickness of the first portion 11 of the first concrete floor slab 10. The concrete beams 13, 15 are poured to a thickness substantially equal to the thickness of the second portion 101 of the first concrete floor slab 10 (i.e. to a thickness substantially equal to the thickness of the integrally formed concrete beams 34, 37). The precast beams 34 and 37 in precast slabs 10 and 16 are co-axial, the precast beams 32 and 33 in precast slabs 10 and 12 are co-axial, and the precast beams 35 and 36 in precast slabs 12 and 14 are co-axial.

Figure 3B:
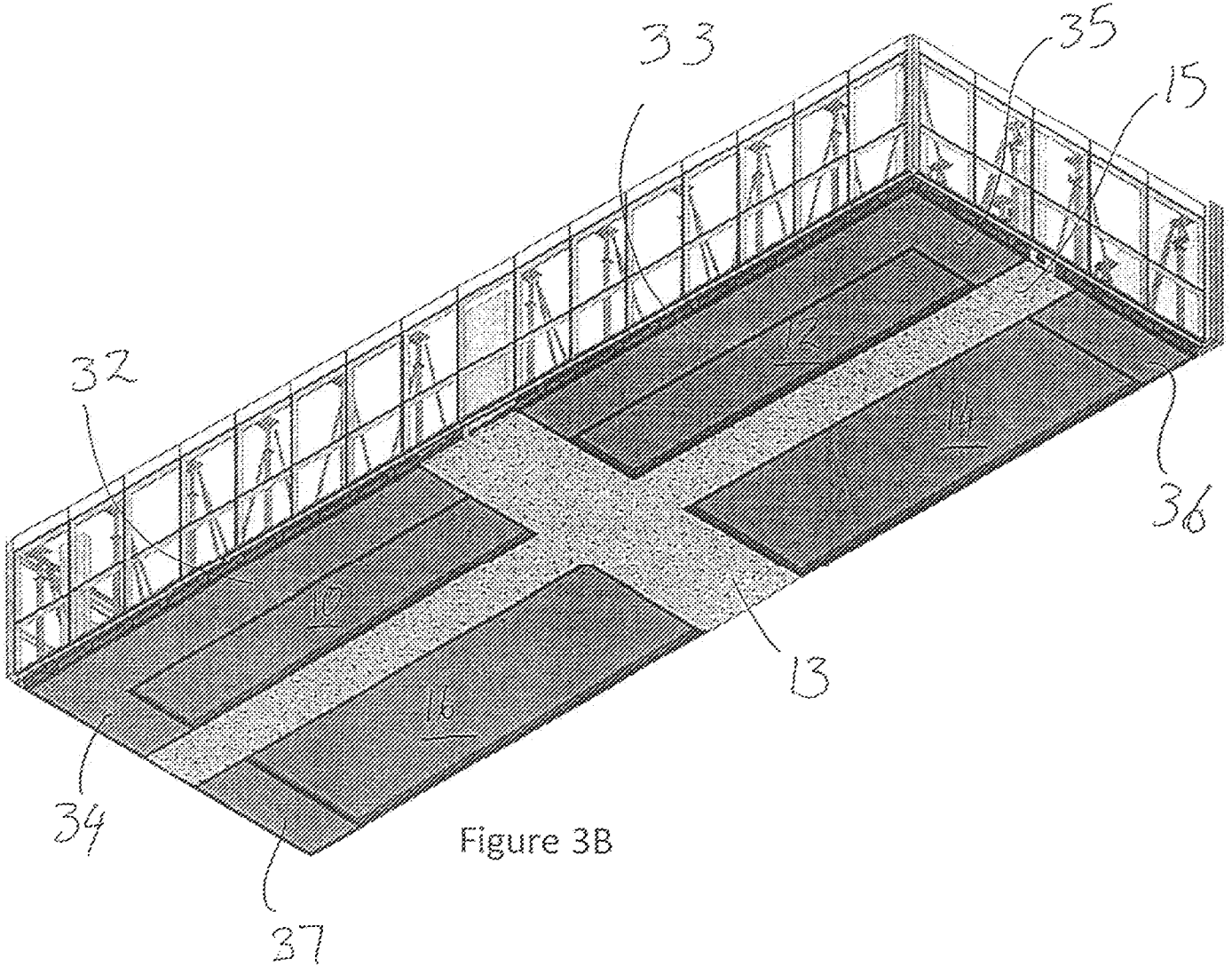
FIG. 3B is a bottom isometric view of the concrete floor in FIG. 3A.

Once the poured beams 13, 15 set precast beams 34 and 37 in precast slabs 10 and 16 form a single continuous beam, precast beams 32 and 33 in precast slabs 10 and 12 form a single continuous beam, and precast beams 35 and 36 in precast slabs 12 and 14 form a single continuous beam. This results in the completed floor slab 17 having five beams in total, as shown in FIG. 3B, some of which are angled to each other. Specifically, the completed floor slab includes a combination of perpendicularly aligned precast and poured beams. The single continuous beams may span the entire length or width of the completed slab 17.

While it is preferable for the poured beams 13, 15 and the integrally formed beams 32, 33, 34, 35, 36, 37 to have substantially the same thickness, it is envisaged that the poured beams 13, 15 could be thicker than the integrally formed beams 32, 33, 34, 35, 36, 37, or that the integrally formed beams 32, 33, 34, 35, 36, 37 could be thicker than the poured beams 13, 15.

The precast beams are cast with reinforcement tie bars 27 protruding from their side edges that are embedded into the wet in situ joint and assist in tying the precast slabs to the poured connections. The tie bars may be in the form of reinforcement bar, or steel angle cast along the edge of a floor slab.

It is envisaged that the building module 20, or the precast concrete slab 10 on its own, could be constructed at a first location, and then moved, for example by being transported from the first location to an installation location, where the building module is installed. The first location may be a factory or a warehouse where the initial components of the first building module 20 may be more easily assembled in an assembly line fashion, in order to assist in shortening overall construction time.

Alternatively, if there is room on the building site, an assembly area may be located, for example, in an area that is designated as a courtyard in the finished building. In this example the first building module 20, or the precast concrete slab 10 on its own, can be constructed on the building site in a designated assembly area before being moved into position, for example by a crane, and installed. It will be understood that locating the assembly area, or factory, on the building site will help reduce transportation costs.

It will be understood that by installing the temporary support members 103 and the façade 21 before the precast concrete floor slabs are moved into the installation position the building site can operate with increased safety. This is because the installation of the outer walls removes the live edge of the building site, thereby eliminating a live edge for workers to fall from. In addition, by removing the live edge the construction process also becomes more efficient as there is no need for external barriers to be installed around the building before workers can enter the worksite.

While the precast concrete slabs 10, 12, 14, 16 are described above as being connected by pouring concrete 11 between the modules, additional steps can be used to further increase the strength of the finished slab 17. Specifically, strengthening can be achieved by use of reinforcement bars or mesh in the wet joint and/or post-tensioning the finished, continuous wet joint/precast combination floor.

Referring now to FIGS. 5 to 9, a post-tensioning technique is demonstrated. Two precast slabs, shown as first precast concrete slab 40 and second precast concrete slab 50, are connected by poured concrete 60. The first precast slab 40 has a bore 42 that extends through the first precast slab 40. The bore may be in the form of a cast conduit into which will be received the tension cable. The bore 42 in the first precast slab 40 extends out of opposite ends of the first precast slab 40. The second precast slab 50 has a bore 52, or cast conduit, that extends through the second precast slab 50. The bore 52 in the second precast slab 50 extends out of opposite ends of the second precast slab 50.

The bores 42, 52 in the first and second precast slabs 40, 50 can be formed using any suitable method. For example, the bores 42, 52 may be formed when casting the precast slabs 40, 50. For example, a conduit (not shown) may be placed in a mould for the precast slab 40 and concrete poured around the conduit so that the conduit is embedded in the precast slab 40, thereby forming a bore in the precast slab 40.

Figure 5:
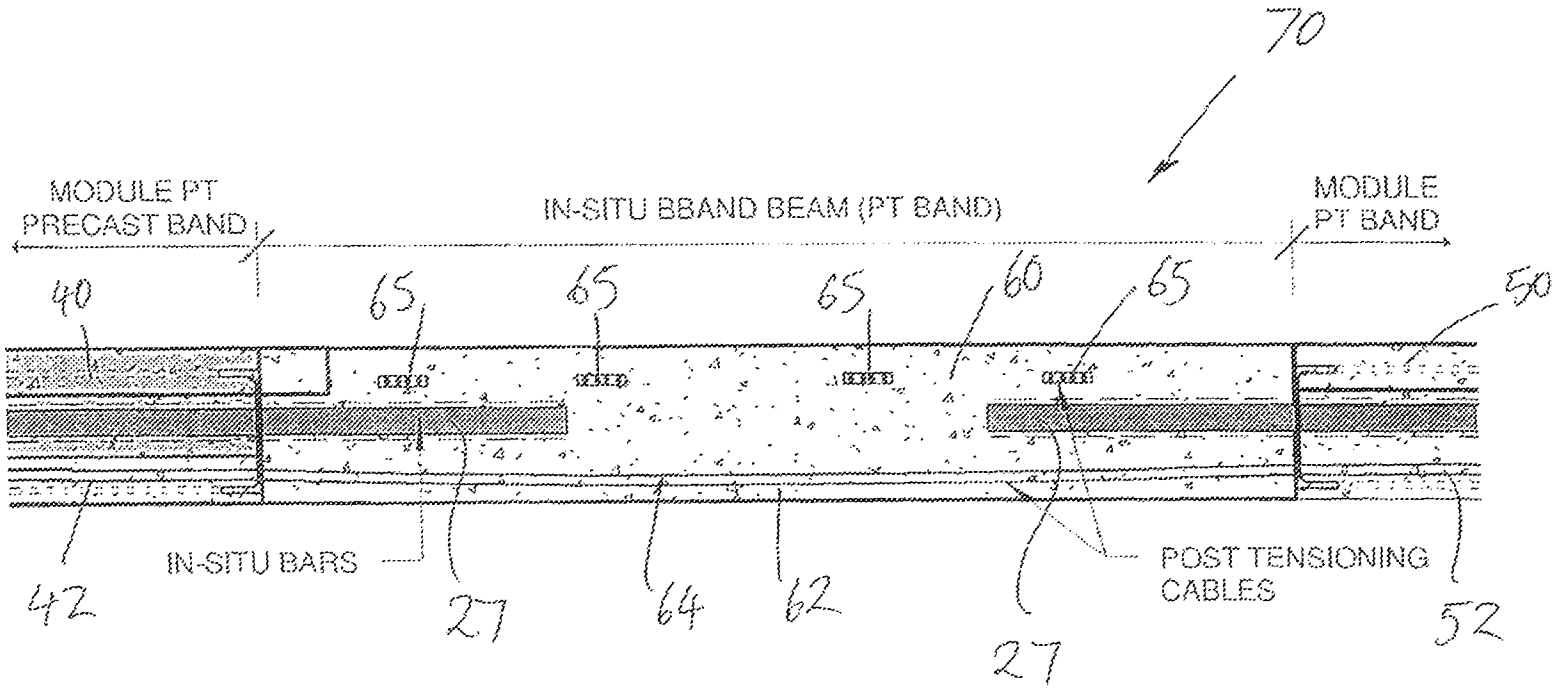
FIG. 5 is a cross-sectional view of a first precast slab and a second precast slab joined together by an in situ concrete connection.

During installation of the precast slabs 40, 50 the first precast slab 40 is installed first. The second precast slab 50 is installed adjacent and spaced from the first precast slab. As shown in FIG. 5, the second precast slab 50 is installed so that it is in the same plane as the first precast slab 40, regardless whether or not the slabs 40, 50 are elevated. The second precast slab 50 is preferably installed so that the bore 52 in the second precast slab 50 is aligned with the bore 40 in the first precast slab 40. More specifically, the second precast slab 50 is preferably installed so that the bore 52 in the second precast slab 50 lies in the same plane as the bore 40 in the first precast slab 40.

A conduit 62 is installed in the formwork between the bore 42 in the first precast concrete slab 40 and the bore 52 in the second precast concrete slab 50 to extend the tensioning passage 64 through both the first and second precast concrete slabs 40, 50. Specifically, the conduit 62 is connected to the bore 42 in the first module 40 and the bore 52 in the second module 50, thereby forming a continuous tensioning passage 64 from one end of the first precast slab 40 to the opposite end of the second precast slab 50.

In other words, the tensioning passage 64 extends the entire way through both the first precast slab 40 and the second precast slab 50, allowing a cable to be fed through the tensioning passage 64 such that the cable extends out of an end of the first precast slab 40, and extends out of an end of the second precast slab 50. The conduit 62 is connected to the bores 42, 52 to form a seal. The seal is fluid tight and prevents the ingress of concrete into the tensioning passage 64.

The tensioning passage may be formed in a draped profile, undulating between slabs and at the outer facade edge of the building (as shown in FIG. 6) to increase the level of tension achieved by post tensioning.

Concrete 60 is poured to connect the first and second precast slabs 40, 50, forming a slab of a building 70. The concrete surrounds the conduit 62, thereby embedding the conduit 62 in the poured concrete 60 as well as the in situ bars protruding from the side edges of the precast floor slabs.

Once the concrete 60 has set a tendon or cable (not shown) is fed through the tensioning passage 64 and the cable is tensioned. Tensioning of the cable applies a compressive force to the first precast slab 40, the second precast slab 50, and the concrete 60 connecting first and second precast slabs 40, 50. Tensioning the completed slab 70 acts to strengthen the slab, allowing it to support more weight.

Figure 7:
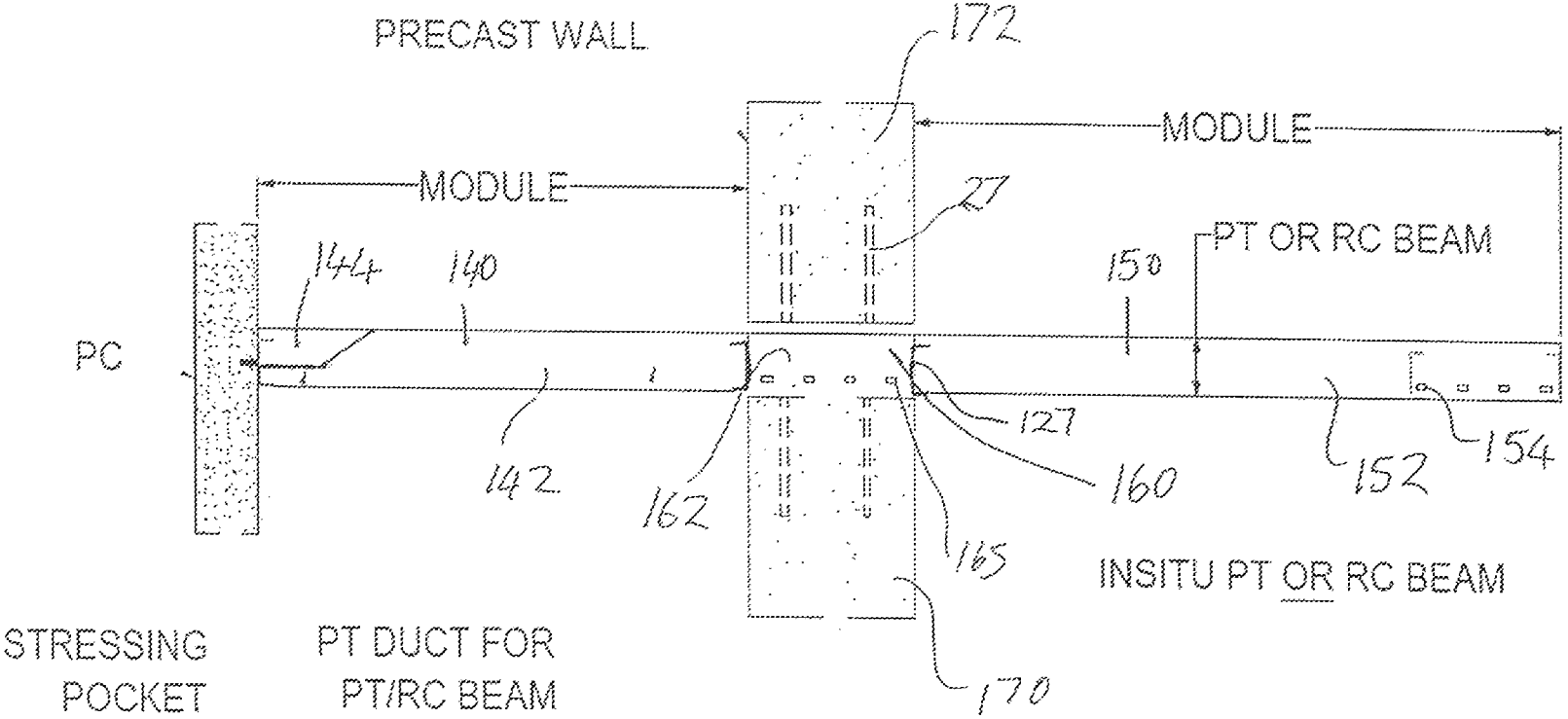
FIG. 7 is a cross-sectional schematic view of an alternative first precast slab and second precast slab joined together by an in situ concrete connection in line with a precast wall.

The tensioning process involves fixing one end, the dead end, of the cable using an anchor (not shown) and then pulling the opposite, live end of the cable using a winch or stressing jack. As shown in FIG. 7, the precast panel 140 may have a stressing pocket 144 that the jack stressing machinery sits in to tension the cable. The stressing pocket can be formed when casting the precast concrete slab by including a sacrificial fibreboard or foam block.

Once the slab has been tensioned to stress the concrete floor under the desired compression the live cable ends are tied and/or grout tube containing the cable is filled with high strength grout under pressure to fix the cable in tension.

While the tensioning passage 64 has been described as a single passage in a single direction, it is envisaged that there could be multiple bores in a single precast concrete slab that are used to form multiple tensioning passages. These bores could be substantially parallel to each other to provide tensioning in a single direction, or they could be angled to one and other, for example perpendicular and overlapping, in order to provide tensioning in two or more directions. Referring to FIG. 7, first precast slab 150 has a first bore 152 and a plurality of second bores 154. The plurality of second bores 154 in the second precast slab 150 are substantially perpendicular to the first bore 152.

Referring to FIG. 5 four tensioning passages 65 (made from conduits) are shown in the intermediate concrete connection 60, which are parallel to each other and perpendicular to the tensioning passage 64 that extends through the first and second precast slabs 40, 50. In addition, while only one cable has been described as passing through the tensioning passage 64, it is envisaged that two or more, three or more, four or more, or five or more cables could be used in each of the tensioning passages 64, 65. As shown in FIG. 5, each tensioning passage 65 has four tensioning cables 66.

Figure 8:
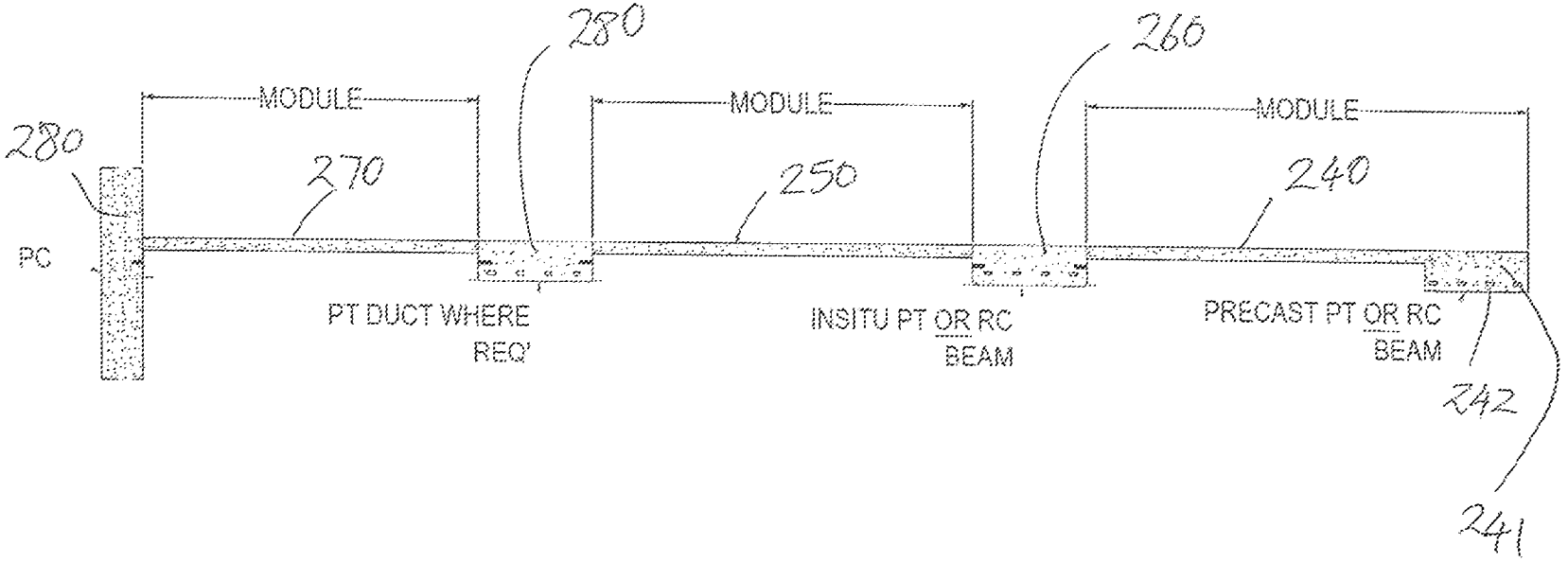
FIG. 8 is a cross-sectional schematic view of three precast slabs connected together side-by-side by two in situ concrete connections therebetween.
Figure 9:
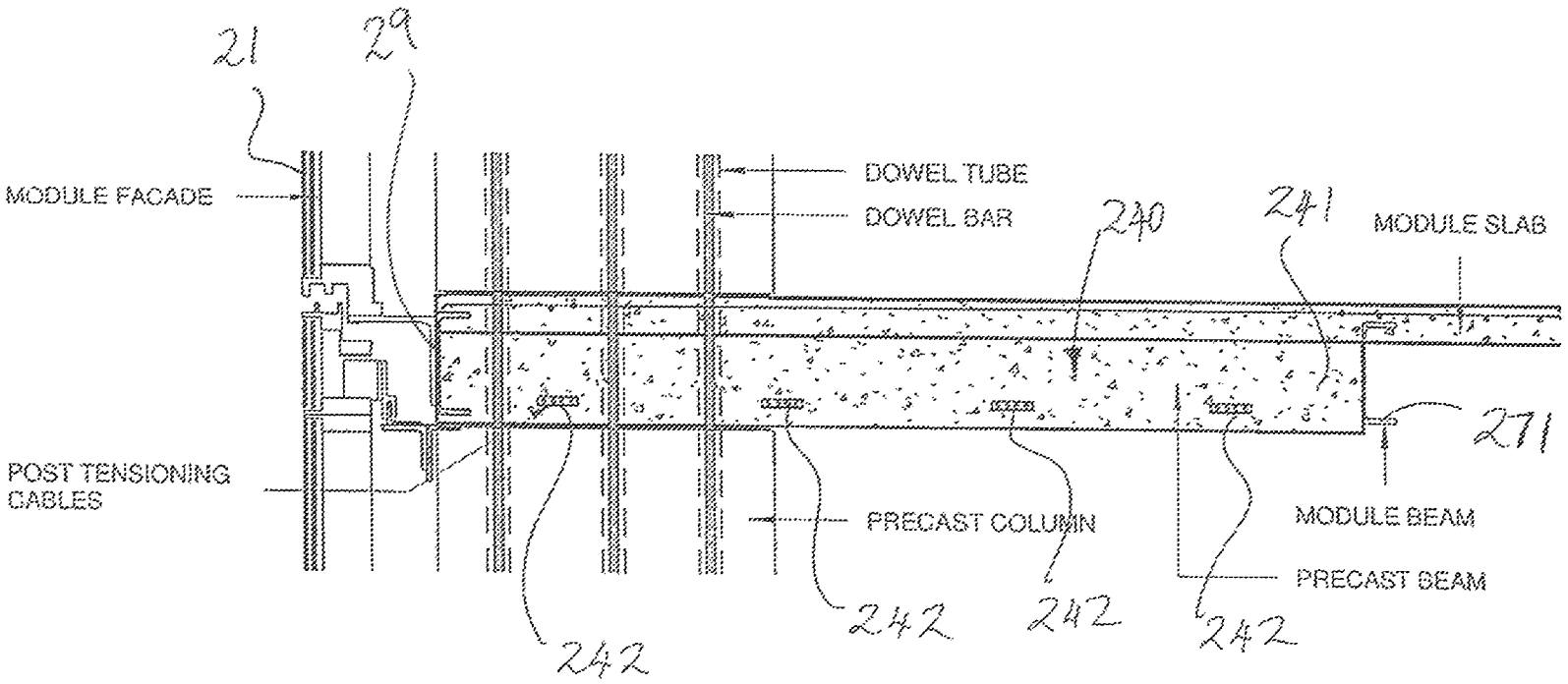
FIG. 9 is an enlarged side view of a precast concrete slab similar to FIG. 8 with a precast beam and attached to a façade side of a building with the precast slab positioned between precast columns.

Referring to FIGS. 8 and 9, the precast concrete slab 240 has a beam 241 and a plurality of bores 242. The bores 242 are located in the precast beam 241.

It will be understood that the method of post-tensioning two precast concrete slabs can be used on its own, or in combination with the method of forming a slab using precast concrete slabs with integrally formed beams. In other words, while the connection to form a post-tensioned slab has been described with reference to modules having one or more precast beams, it will be understood that the method of connecting modules to form a slab could be applied to modules without precast beams.

It is also understood that steel reinforcement bars and/or mesh can be used in place of post-tensioning in order to strengthen the completed floor including the in situ connection between precast floor slabs.

In addition, as described above with reference to the precast concrete slabs 10, 12, 14, 16, the first and second precast concrete slabs 40, 50 may form the base of a building module for a modular building. The first and second precast concrete slabs 40, 50, or any building modules using the first and second precast concrete slabs 40, 50 to form the base of the building module, may be made offsite, as described above with reference to precast concrete slabs 10, 12, 14, 16 and building modules 20, 22, 24, 26.

Referring to FIGS. 1 to 6, an example of forming a floor slab of a multistorey building will now be described in detail. The process begins in a warehouse, where steel beams are positioned on a construction bed/table. Conduits for forming tensioning passages are laid cross ways and overlappingly tied in position. A sacrificial fibreboard block is positioned to form a stressing pocket. Alternatively, the table may be laid with reinforcement bar instead of tensioning conduits. Angles and/or tie bars (generally more reinforcement bars) are also aligned to protrude from the outer edges of what will be the floor slab.

The bed/table has recesses or voids that result in the precast concrete slab 10 being thicker in these areas. These areas of greater thickness form the integrally formed precast beams 32, 34 when the concrete has set. The recesses or voids are perpendicular, resulting in perpendicular beams 32, 34.

Once the table has been prepared concrete is poured to form a precast concrete slab 10 that forms a floor of a building module 20. This process embeds the conduits and/or reinforcement bar into the precast concrete slab 10 and creates beams that are integrally formed with the precast concrete slab 10. The steel beams are also partially embedded in the concrete slab, which add rigidity to the precast concrete slab 10.

Once the concrete slab has set the precast concrete slab 10 is removed from the construction bed/table. The precast concrete slab 10 is used to form a building module for a modular building. This can involve installing support structures, walls, fixtures and fittings, as desired.

Once the building module has been completed to the desired state the first building module 20 is transported from the warehouse to an installation location, such as a building site. The first building module 20 is then installed at the building site (either on the ground floor or above another building module already installed.

Aside from the ground level modules, installation will involve the building modules being craned and assembled in storeys, with the precast floor slabs of each module suspended above the floor below.

Once the first building module 20 has been installed a second building module 22 is installed spaced adjacent to the first building module. The second building module 22 is manufactured and assembled in warehouse in a similar way to the first building module 20. The second building module 22 also has precast concrete beams 33, 35 and bores for tensioning cables. The second building module 22 is positioned so that the integrally formed beam 33 in the second precast concrete slab 12 is parallel and in the same plane as the integrally formed beam 32 in the first precast concrete slab 10. The second building module 22 is also positioned so that at least one bore in the second precast concrete slab 12 is aligned, and in the same plane as, at least one bore in the first precast concrete slab 10.

Once the first and second building modules 20, 22 have been installed formwork is either erected in the space between the modules 20 and 22, or is already provided as an integrally extending flange of the module. In the embodiment illustrated in FIG. 1 the formwork is made from sacrificial fibreboard or the like to take the desired form of the finished connection. This could be in the form of a poured beam, as described above, or a simple level connection between the precast slabs 10 and 12 that continues in the same plane as the precast slabs.

If using post-tensioning, a conduit is installed between the aligned bores in the first and second precast concrete slabs 10, 12 to form a tensioning passage that extends through both the first and second precast concrete slabs 10, 12.

A concrete beam, or simple connection, is then poured between the first and second precast concrete slabs 10, 12 to connect the first and second precast slabs 10, 12. This process forms a completed slab. The poured concrete beam surrounds the conduit connecting the aligned bores, thereby embedding the conduit in the poured beam. Once the poured beam sets the precast beams 32 and 33 form a single continuous beam. The poured beam is perpendicular to the continuous beam (made from the precast beams 32 and 33) that it creates.

Once the concrete beam has set four tensioning cables are fed through the tensioning passage so that the cables extend out of the first precast concrete slab and the second precast concrete slab. The end of the cables that extend from the second pre-cast slab 12 are fixed to the second pre-cast slab 12. The ends of the cables that extend from the first pre-cast slab 10 extend into the stressing pocket in the first precast slab 10. A stressing jack is used to tension the cables. Once the cables have been tensioned excess cable is cut off and the stressing pocket in the first precast slab 10 is filled with concrete to form a flat upper surface and to hide the cables.

While feeding the cable through the tensioning passage has been described as occurring after the concrete beam has been poured and has set, it is envisaged that the cable could be fed through the tensioning passage any time after the conduit between the aligned bores has been installed.

While the methods above have only been discussed in relation to two slabs connected side-by-side, or four slabs in a 2×2 configuration, it is envisaged that multiple other configurations could also be created. For example, the slabs may be configured in a 2×1 configuration, a 2×3 configuration, a 2×4 configuration, a 3×4 configuration etc. For example, FIG. 8 illustrates three precast concrete slabs 240, 250, 270 side-by-side.

Precast slab 240 has a precast beam 241. The three precast slabs 240, 250, 270 are connected together by poured concrete beams 260, 280. The precast slab 240 has a plurality of bores 242 for receiving a tensioning cable. Precast slab 270 is connected to a precast outer wall 280.

As shown in FIG. 9, the precast slabs, such as slab 240, may be cast with a perimeter, or partial perimeter, of prefabricated channel (PFC) 271 which adds rigidity and strength to the slab. The PFC may also take part in the side attachment of wall structures, such as facades. Alternatively, other fixing means such as brackets may be provided on the slab for side attachment of wall structures. It is understood the slab may be sufficiently stable during construction to not require any PFC.

The method described herein may also include vertically inserting a pre-fabricated concrete wall panel in between the adjacently spaced precast floor slabs. FIG. 7 illustrates a lower precast wall panel 170 inserted below and between precast floor slabs 140 and 150. In situ connection 160 is formed between slabs 140 and 150 and contains tension conduits 162, 165 extending in perpendicular directions. As discussed below, connection 160 can be cast to tie into the upper end of lower wall panel 170. An upper precast wall panel 172 is positioned on top of connection 160, with lower panel 170 bearing the weight of upper panel 172.

Pre-fabricated wall panels are also described in the above-mentioned co-pending International Patent Application titled "METHODS AND APPARATUS FOR CONSTRUCTING MULTI-STOREY BUILDINGS", and which also claims priority from Australian provisional application no. 2016902460 filed on 23 Jun. 2016, and from Australian provisional application no. 2016903025 filed on 1 Aug. 2016 and titled "METHOD FOR CONSTRUCTING A CONCRETE FLOOR IN A MULTISTOREY BUILDING".

The wall panel can be lowered in position by crane and forms structural support for the building. The wall panels are tied at an upper end to the precast floor slabs and formwork provided around the wall panel and between the floor slabs, as required, along the length of the upper end of the wall panel. Concrete can then be poured into the formwork to form a wet joint to finish the floor and incorporating the wall panel on an underside of the floor including any tie bars.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of constructing a multistorey building, the method including:

pre-fabricating a first building module off-site, the first building module having a precast concrete floor and a permanent outer wall fixed at a side edge of the floor so that the outer wall is suspended by the concrete floor to extend vertically upward and defines part of a façade of the building; wherein the outer wall is suspended by the floor to extend laterally and upwardly from the side edge of the floor by a connection that extends outwardly and along the side edge such that the connection bears the load of the outer wall at the side edge during transportation from off-site to a construction site, the connection comprising a bracket of the outer wall connected to a fixing joint embedded along the side edge of the floor;

transporting the first building module assembled with façade to the construction site and placing the first building module by crane adjacent an already installed second building module, whereby the outer wall forms an external safety barrier; and horizontally joining the first floor with an adjacent floor of the second building module, thereby forming a concrete floor of a building.

2. The method claimed in claim 1, including installing a third building module having a third precast concrete floor above the first precast concrete floor.

3. The method claimed in claim 2, including using a temporary support member or a permanent support member defining an upstanding support member for supporting the third building module above the first building module.

4. The method claimed in claim 3, including installing a permanent support structure between the first and third building modules to vertically support the third building module above the first building module, and removing the temporary support member.

5. The method claimed in claim 3, including attaching the temporary support member to the floor of the first building module off-site.

6. The method claimed in claim 4, including attaching the temporary support member to the floor of the first building module off-site.

7. The method claimed in claim 1, including post tensioning the precast floor slabs by installing a conduit between bores extending through the first precast floor and the second precast slab to form a tensioning passage that extends through both the first and second precast floors;

connecting the first and second precast floors, thereby forming a slab of a building; and feeding a tensioning cable through the tensioning passage and tensioning the tensioning cable.

8. The method claimed in claim 1, including:

prefabricating the first and second precast concrete floors with conduits forming a tensioning passage;

installing the first and second building modules so that the tensioning passages in the first and second precast concrete floors are aligned; and feeding a tension cable through the conduit in the aligned first and second precast concrete floors and post-tensioning the cable.

9. The method claimed in claim 1, including precasting the first concrete floor slab to include a steel beam at least partially embedded into the first precast concrete floor slab.

10. The method claimed in claim 1, including vertically inserting a pre-fabricated concrete wall panel in between the adjacently spaced precast floor slabs, erecting formwork between the precast floor slabs and pouring concrete into the formwork to tie the vertical wall panel to the floor slabs.

11. A method of constructing a multistorey building, the method including:

pre-fabricating first and second building modules off-site, the first and second building modules having precast concrete floors and upstanding support members attached to the floors for supporting an upper floor; the first and second building modules each further comprising a permanent outer wall extending upwardly to define part of a façade of the building, wherein the outer wall is fixed at a side face of each concrete floor via a connection that extends outwardly and along the side face of the floor, the connection being configured to bear the load of the outer wall at the side face of the respective concrete floor during transportation from off-site to a construction site, the connection comprising a bracket of the outer wall connected to a fixing joint embedded along the side face of the floor;

transporting the first and second building modules assembled with facades to the construction site;

placing the first building module adjacently spaced from the second building module installing a third building module having a third precast concrete floor above the first and/or second building module and supporting the third precast concrete floor slab on temporary support members;

installing a permanent support structure supporting the third building module above the first and second building modules; and removing the temporary support members.

* * * * *